US010287729B2

(12) United States Patent
Casanova Royo

(10) Patent No.: US 10,287,729 B2
(45) Date of Patent: May 14, 2019

(54) PROCESS FOR OBTAINING A FABRIC WITH THE APPEARANCE OF LEATHER, IMITATION LEATHER, AND THE FABRIC OBTAINED

(71) Applicant: TEJIDOS ROYO, S.L., Picassent (ES)

(72) Inventor: Jose Ignacio Casanova Royo, Picassent (ES)

(73) Assignee: TEJIDOS ROYO, S.L., Picassent (Valencia) (ES)

( * ) Notice: Subject to any disclaimer, the term of this patent is extended or adjusted under 35 U.S.C. 154(b) by 344 days.

(21) Appl. No.: 15/101,956

(22) PCT Filed: Mar. 31, 2014

(86) PCT No.: PCT/ES2014/070245

§ 371 (c)(1),
(2) Date: Jun. 6, 2016

(87) PCT Pub. No.: WO2015/092091

PCT Pub. Date: Jun. 25, 2015

(65) Prior Publication Data

US 2016/0312400 A1 Oct. 27, 2016

(30) Foreign Application Priority Data

Dec. 17, 2013 (ES) ..... 201331845

(51) Int. Cl.
*D06N 3/04* (2006.01)
*D06N 3/00* (2006.01)

(52) U.S. Cl.
CPC ..... *D06N 3/042* (2013.01); *D06N 3/0061* (2013.01); *D06N 3/0063* (2013.01); *D06N 2203/041* (2013.01); *D06N 2209/142* (2013.01); *D06N 2209/147* (2013.01)

(58) Field of Classification Search
CPC .... D06N 3/042; D06N 3/0061; D06N 3/0063; D06N 2203/041; D06N 2209/142; D06N 2209/147
See application file for complete search history.

(56) References Cited

U.S. PATENT DOCUMENTS

| | | | | |
|---|---|---|---|---|
| 3,853,608 | A * | 12/1974 | Hammer | D04H 1/4334 156/307.3 |
| 6,479,153 | B1 | 11/2002 | Kato et al. | |
| 2005/0244654 | A1 | 11/2005 | Wang et al. | |
| 2011/0111660 | A1* | 5/2011 | Morino | C09J 133/08 442/149 |
| 2012/0315485 | A1 | 12/2012 | Iwazumi et al. | |

FOREIGN PATENT DOCUMENTS

| | | | |
|---|---|---|---|
| CN | 101634109 | A | 1/2010 |
| EP | 1 041 191 | A2 | 10/2000 |
| WO | 2011/163461 | A1 | 12/2011 |

OTHER PUBLICATIONS

International Search Report of PCT/ES2014/070245, dated Jul. 4, 2014.

* cited by examiner

*Primary Examiner* — Amina S Khan
(74) *Attorney, Agent, or Firm* — Collard & Roe, P.C.

(57) ABSTRACT

The invention refers to the way of obtaining a fabric with the appearance of leather, imitation leather, from a fabric that can be an elastic technical fabric, to which a paste is applied, formulated with an acrylic base resin with inorganic fillers, melamine resins, silicone antifoam, polyethylene glycol, urea, synthetic acrylic thickeners and water-based dyes, in suitable percentages for obtaining a fabric with the appearance of hide or leather that is antistatic, rupture resistant, tear resistant, cut resistant, abrasion resistant and impact resistant, providing an appearance similar to leather and with a high capacity for recovering the initial form of the fabric, due to its elasticity. The invention also refers to the product or fabric obtained with this process.

10 Claims, No Drawings

PROCESS FOR OBTAINING A FABRIC WITH THE APPEARANCE OF LEATHER, IMITATION LEATHER, AND THE FABRIC OBTAINED

CROSS REFERENCE TO RELATED APPLICATIONS

This application is the National Stage of PCT/ES2014/070245 filed on Mar. 31, 2014, which claims priority under 35 U.S.C. § 119 of Spanish Application No. P201331845 filed on Dec. 17, 2013, the disclosures of which are incorporated by reference. The international application under PCT article 21(2) was not published in English.

OBJECT OF THE INVENTION

This invention refers to a process for obtaining a fabric with the appearance of leather, imitation leather, using a specific process and a paste that is applied to a fabric support, forming a fabric-resin complex.

The paste that is applied contains an acrylic resin with inorganic fillers as the main product to which is also added melamine resins, silicone antifoam, polyethylene glycol, urea and synthetic acrylic thickeners. If the fabric is to be given a final colour, water-based or powdered dyes are added to the paste, or no dyes are added if no colour is desired, and in the latter case, the fabric can be dyed later. The paste can be applied to a fabric support, which has conventional, technical or protective features.

The object of the invention is to achieve a fabric-resin complex with the features and appearance of leather or hide where, depending on the features of the supporting fabric, the resulting complex can have technical and protective features such as flame retardant, antistatic, rupture resistant, tear resistant, cut resistant, abrasion resistant, or impact resistant properties, being very similar to leather with the ability to recover the initial shape of the fabric due to its elasticity, breathability, ease of maintenance, waterproofness, stain resistance, and taken together, with totally innovative features and properties that do not exist today.

The fabric with the appearance of leather, imitation leather, can primarily be used for the manufacture of garments in general, protective clothing and/or technical clothing, fabrics for the home and footwear.

BACKGROUND OF THE INVENTION

Many different types of fabric are known with the appearance of hide or leather.

In this sense, there is patent CN101634109 on an aqueous polyurethane resin used for the manufacture of synthetic leather. This document reveals an aqueous polyurethane resin where the ingredients include, apart from the previously mentioned aqueous polyurethane resin, an anti-foaming agent that helps obtain a product that simulates synthetic leather.

Another document that reveals a composition for coating is international patent application WO2011163461. This document advocates a composition based on polyurethane and other components as dispersing agents and water, which provide a high refractive index.

In addition to these documents that reveal coating based on polyurethane as the main ingredient of their composition, there are other fabrics for protection or with technical features with the appearance of hide or leather, which are listed below:

- Natural hide fabrics used for obtaining hide, leather or suede garments, fashion fabrics and in some cases protective fabrics with reinforcements in critical areas such as the shoulders, back and primarily joints, and where the reinforcements are applied to protect from burns, cuts and abrasions of the skin in case of falls or impacts.
- Synthetic fabrics with Cordura type protection, based on high tenacity polyamide combined with para-aramid reinforcements, able to protect the body from all attacks, with a very much lower weight.
- Independently of these single layer fabrics, there are multi-layer textile materials with insulation capacity such as Coolmax®, Thermolite®, Thinsulate®, etc.
- There are also membranes to provide protection against the rain and wind such as Goretex®, Sympatex®, wind Stopper®, applied by the thermobonding or hot melt system applied over technical fabrics.
- Fabrics of polyurethane (PU) Poly Skin, based on coatings of PU over woven or non-woven fabrics, knitted fabric generally ketten, for garments, automotive or home upholstery, that are based on polyurethane (PU) resins.

The drawbacks and problems that have previously been described and are known of these types of fabrics specifically include the following:

- For leather and hide type fabrics, these are cold in winter and hot in summer, and are also not very breathable. They are not water-repellent or fireproof, and when exposed to the elements easily degrade, needing maintenance with leather moisturising nutrient creams to prevent them becoming brittle and cracking, which finally tears the fabric, making the corresponding operation of cleaning difficult and delicate. Furthermore, this fabric, known as leather or hide, does not resist fire and hardens and deforms on exposure to flames or excessive heat, and can even burn, is not generally waterproof and often stains, is difficult to maintain and clean, and cannot be washed or dried at home.
- With respect to Cordura type fabrics based on high tenacity polyamide, although they offer generally good protection, the drawbacks are that they are not at all similar to hide or leather, are not fireproof, burn on exposure to flames, lack flexibility and ergonomics and are formed by multiple layers. Although it is a breathable fabric, it does not have the ability to capture body moisture and evaporate it in the physiological process of body perspiration, it is also not comfortable and its appearance, as previously mentioned, is not that of hide or leather.
- With respect to Poly Skin fabrics based on polyurethane (PU) and polyvinyl chloride (PVC) resins, their drawbacks are generally that they are not easy to maintain, are not resistant to rupture, abrasion, tearing and cutting, they burn easily on exposure to flames or fire, are not breathable, are easily stained, they cannot be washed and dried at home, they lack flexibility or have limited flexibility, they often crack and the polyurethane film degrades with time and although they can be used in manufactured garments, they do not hard wearing and are generally used for upholstery, footwear or automotive articles.

Therefore, we have observed that fabrics with the appearance of leather that resolve all the previously mentioned drawbacks are not known in the state of the art. In addition, they do not use polyurethane in the ingredients during the preparation of the resin or paste that is applied over the fabric, which, among other disadvantages, degrades with use of the fabric.

DESCRIPTION OF THE INVENTION

The process proposed here was conceived to obtain a fabric with the appearance of leather, imitation leather, that can be waterproof, stain-resistant, breathable and easy to maintain. When using a fundamentally technical protective fabric as the support, a fabric can be obtained that has the appearance of leather, imitation leather, and is fireproof, fire and flame resistant, anti-static and resistant to rupture, tearing, cutting, abrasion and impact.

The fabric with the appearance of leather, imitation leather, of the invention is obtained by applying the process to a supporting fabric, generally made of 2×1, 3×1 twill weave, sateen, satin or other types of weaves, taffeta and telethon, double cloths or mixtures thereof, and by the combination of threads that can be conventional yarns of natural or synthetic cellulose materials, and also with technical warp or weft yarns, which can be elastic, to which is applied the process and finishing formula to obtain a fabric complex with the appearance of leather, imitation leather.

This fabric has better performance to that existing on the market due to its protection, high breathability, comfort, durability and ease of maintenance and, depending on the yarns used for the construction of the fabric, can also be fire resistant, elastic, and resistant to abrasion, tearing, rupture and cutting.

When using technical yarns in the construction of the fabric, these are based on a new process developed for making fabrics that obtain technical fabrics with multi-standard, functional, comfortable and ergonomic properties and with higher performance than those constructed with conventional yarns.

Obtaining new technology technical yarns is based on the use of a yarn with a central core coated at least 80% with one, two or more fiber rovings with special features, simultaneously drawing and twisting these fiber rovings about the central core, obtaining as a result yarns with high resistance, flexibility, feel and visual appearance of greater coverage of the central core compared to existing Core-Twist yarns on the market. By virtue of this range of yarns, technical fabrics have been developed that can be multi-standard, functional, comfortable and ergonomic, with very much better properties than those made with conventional yarns or with Core-Twist technology.

In order to obtain technical fabrics such as those used in the invention, they should be based on technical warp yarn with the technology of the invention, with one or more cores of continuous yarn of 20 to 600 Den (textured or not textured), in such a way that the covering of the core of these yarns is obtained from one, two or more fiber rovings that can contain at least a percentage of fibres with technical features.

The cores of these technical yarns used will be continuous filaments, elastomer, bi-elastomer, high tenacity polyester, high tenacity polyamide 6.6 or polyamide 6.6 plus carbon ceramic or UHMW polyethylene filaments, where the polyester and the polyamide 6.6 will be between 40 Den and 600 Den, while the polyamide 6.6 plus carbon ceramic will be between 22 Den and 40 Den, and the UHMW polyethylene will be up to 600 Den.

In addition, para-aramids and also meta-aramids of up to 440 Den can be used in the cores of the technical yarns.

The fibres used for the cover are fundamentally natural fibres, artificial and/or synthetic cellulose, the latter based on lyocell, modal, viscose, polyester, viscose FR modal FR, modacrylic, polyamide or fireproof polyamide, meta-aramid, para-aramid, polyacrylate or polyacrylonitrile fibres, carbon fibres and antistatic fibres or mixtures of some of these in order to obtain a fireproof fabric.

With respect of the process for obtaining the fabric with the appearance of leather, imitation leather, this is based on applying to the conventional or technical support fabric, a paste where the base is primarily an acrylic resin with inorganic fillers, and in addition to this are added melamine resins, silicone antifoam, polyethylene glycol, urea, synthetic acrylic thickeners and, if desired, dyes to obtain a final colour on the fabric, aqueous or powdered dyes, in proportions of:

80-85% acrylic resin with inorganic fillers;
1-7% dyes;
4-6% polyethylene glycol;
2-4% melamine based fixative;
0.3-0.7% anti-foaming agent based on silicone resin;
0.9-1.1% urea;
1-1.5% synthetic acrylic thickener to achieve a viscosity that must be situated between 10,000 and 15,000 cP.

If fluorocarbon resins are added to the resulting paste, the resulting final fabric will also have anti-stain and waterproof properties.

If dyes are not applied to the paste, a colourless paste is obtained so that when the fabric is finished or the garment made with this fabric, it is possible to endow the fabric-resin complex with colour using fabric dyes or the manufactured garment can be coloured with aqueous or powdered dyes later. This second mode of work has the advantage that the fabric or garment can be dyed at the last moment and the most appropriate colour selected depending on the current fashion. The dyes that can be used include aqueous based or powdered dyes such as indigo, sulphurous, vat, reactive, pigment, dispersed, acids and direct dyes or a combination of these.

Based on this formulation of resin or paste that is applied over the fabric, a fabric with the appearance of leather, imitation leather, is obtained, with this paste making up between 5% and 40% of the weight of the fabric.

The fabric obtained has the properties and features already mentioned such as high breathability, protection, comfort and ease of maintenance and additionally can be, due to the properties of the technical yarns that form the base fabric, anti-static, rupture resistant, tear resistant, cut resistant, abrasion resistant and impact resistant, having an appearance very similar to leather and a high capacity of recovering its initial shape due to its elasticity, and when using fireproof technical fibre yarns, it also has the features of being resistant to flames and fire.

The advantages of the application of an acrylic resin base with inorganic fillers compared to polyurethane (PU), which has been used to date to make imitation hide or leather articles are:

higher resistance to abrasion of the film.
continual washing and drying cycles can be performed in industrial or domestic washing and drying machines.
higher resistance to chemical products.
enables better anchoring of the paste products to the fabric.
better behaviour to external environmental conditions.
does not contain isocyanate.
higher hydrophilicity.

the more often the fabric is washed and used, the more the fabric takes on the appearance of hide or leather compared to polyurethane (PU), which degrades.

The resulting base paste is applied on the fabric as a coating by rotary screen, over perforated cylinder, air scraper or transfer processes.

In the case of rotary screen application, the cylinders used for the application will have a sheet thickness of between 90 and 120 microns, a hole diameter that varies between 92 and 160 microns and between 20% and 30% of open area, which gives a deposition of the product over the fabric in this case that varies between 12% and 27%.

The interior of the perforated cylinder where the paste is dispensed contains a rod that can be smooth or ribbed, solid or hollow and of different diameters that can vary from 8 to 30 millimeters.

Suitable selection of the rod will depend on the thickness of the supporting fabric, the cylinder used, the paste applied and the grams of resin to be applied.

In the case of application by scraper, the tip of the scraper can vary in shape and thickness and depending on these, more or less paste may be deposited on the technical fabric. In this case, the thicknesses can vary between 1 and 6 mm and the height of the scraper over the fabric between 1.5 and 5 mm. Other variables to be controlled are the fabric tension, the angle of the scraper over the fabric and the viscosity of the paste. More of less paste can be deposited depending on these variables.

When the paste has been applied over the fabric, the resulting product is dried in a hot air chamber at a temperature of 130° C. to 160° C. and then the coating is polymerised at between 170° C. and 190° C. for around one minute to ensure stability and solidity of the applied chemical structure. At the same time, the fabric is passed through a pressure calender at a temperature of between 150° C. and 200° C. to ensure good adhesion or anchorage of this resin layer to the fabric.

In the case of application by transfer, the paste is applied on paper and this is later applied on the fabric. Next, the paste-paper-fabric complex is dried and passed through a pressure calender in order to separate the paper from the paste and the fabric. Finally, the paste-fabric complex is polymerised to ensure adhesion of the paste to the fabric.

In all cases, a definitive textile fabric-resin complex is obtained that is solid, resistant, flexible and easy to maintain, which can be washed and dried in either a domestic or industrial drier.

The advantages of the fabric-resin complex obtained according to the process of the invention is that the fabric has the appearance of leather, imitation leather, but has large advantages compared to current fabrics, such as:

- It is an alternative to leather or hide, improving the performance of conventional leather materials.
- It is a material that is easy to maintain, with the possibility of subjecting it to continual domestic or industrial washing and drying cycles.
- It is a breathable material.
- It is an elastic material.
- It is an imitation leather material that is waterproof and stain resistant.

Depending on the technical features of the supporting fabric to which the process is applied, it is possible to obtain a fabric-resin complex with the following technical features that were not known to this date:

- Fireproof, resistant to flames and fire and can be used as a protective fabric.
- Antistatic.
- A fabric in which the garment is ergonomic and therefore adapts to the user's anatomy.
- A fabric that due to its elasticity can adjust to the body and improve aerodynamic friction and therefore reduce air resistance in motor sports.
- Much more resistant to breakage, tearing, cutting and abrasion by impact compared to the fabrics of leather or imitation leather on the market and therefore more resistant to falls in motor sports.
- More comfortable, with freedom of movement, ergonomic, elastic and breathable, than comparable fabrics on the market.
- With rebirthing and anti-ageing effect, improving the look and shine on use, seeming to be newer the more it is used.
- A fabric that is more flexible, softer and less abrasive than conventional leather fabrics, by virtue of the products of the paste and of the technical design of the yarn based on the spinning process and the mixture of fibres selected.
- A fabric that enables a wide range of colours to be applied, including high visibility colours, that is not possible with conventional leather fabrics.

EXAMPLE OF PREFERRED EMBODIMENT

The process is applied, as described above, to a technical fabric, in such a way that the paste is previously dyed using pigmented dyes or aqueous based reagents in proportions already indicated in the "description of the invention" section.

Also, in another example of embodiment, the process is applied as described in the previous paragraph, but applying the paste without dyeing, performing the dyeing of the fabric after the garment has been made with appropriate reactive, direct or pigmented dyes.

The invention claimed is:

1. A process for obtaining an imitation leather fabric comprising applying a composition on a base fabric, wherein the composition comprises 80-85% of an acrylic resin with inorganic fillers, between 2-4% of a melamine resin as a fixative, between 0.3 and 0.7% of a silicone antifoam, between 4 and 6% of polyethylene glycol, between 0.9 and 1.1% urea and between 1 and 1.5% synthetic acrylic thickeners, wherein the viscosity of the composition is between 10,000 and 15,000 cP.

2. The process for obtaining an imitation leather fabric of claim 1, wherein the composition that coats the fabric further comprises between 1 and 7% water-based or powdered dyes selected from the group consisting of indigo, sulphur, vat, reactive, pigmented, dispersed, acids and direct dyes or a combinations thereof.

3. The process for obtaining an imitation leather fabric of claim 1, wherein the composition is applied without dyeing the fabric and the fabric-composition complex is later subjected to dyeing by applying water-based or powdered dyes.

4. The process for obtaining an imitation leather fabric of claim 1, wherein the composition is applied on the fabric by means of rotary screen, scraper, perforated cylinder, transfer or a combination thereof.

5. The process for obtaining an imitation leather fabric of claim 1, wherein the composition is applied on the fabric in an amount of between 5% and 40% by weight of the fabric.

6. The process for obtaining an imitation leather fabric of claim 1, wherein the composition applied on the fabric is dried and subsequently polymerized.

7. The process for obtaining an imitation leather fabric of claim 6, wherein the fabric with the dried and polymerized composition is calendered at a temperature of between 150° C. and 200° C.

8. The process for obtaining an imitation leather fabric of claim 1, wherein the composition that coats the fabric further comprises fluorocarbon resins.

9. The process for obtaining an imitation leather fabric of claim 1, wherein the fabric on which the composition is applied comprises a combination of technical yarns with the core covered by one or more fiber rovings that contain, at least partially, natural, artificial, synthetic, fireproof fibers or a mixture thereof.

10. The process for obtaining an imitation leather fabric of claim 9, wherein the core of the technical yarns used in the fabric is a continuous or textured yarn.

* * * * *